United States Patent [19]

Davis

[11] Patent Number: 4,832,124

[45] Date of Patent: May 23, 1989

[54] SUBSEA WELL HEAD TEMPLATE

[75] Inventor: Peter J. R. Davis, Aberdeen, Scotland

[73] Assignee: Texaco Ltd, London, England

[21] Appl. No.: 134,127

[22] Filed: Dec. 17, 1987

Related U.S. Application Data

[63] Continuation of Ser. No. 63,888, Jun. 19, 1987, abandoned, which is a continuation-in-part of Ser. No. 834,164, Feb. 27, 1986, abandoned.

[30] Foreign Application Priority Data

Jan. 3, 1985 [GB] United Kingdom ..... 8505327

[51] Int. Cl.[4] ..... E21B 43/017

[52] U.S. Cl. ..... 166/339; 166/360; 166/366

[58] Field of Search ..... 166/366, 338, 342, 343, 166/360, 339, 356

[56] References Cited

U.S. PATENT DOCUMENTS

| | | | |
|---|---|---|---|
| 3,618,661 | 11/1971 | Peterman | 166/366 |
| 3,633,667 | 1/1972 | Falkner, Jr. | 166/366 |
| 4,036,295 | 7/1977 | Kirkland et al. | 166/342 |
| 4,120,362 | 10/1978 | Chateau et al. | 166/366 |
| 4,192,383 | 3/1980 | Kirkland et al. | 166/366 |
| 4,438,817 | 3/1984 | Pokladnik et al. | 166/357 |
| 4,625,806 | 12/1986 | Silcox | 166/366 |

*Primary Examiner*—Jerome W. Massie
*Assistant Examiner*—Terry Lee Melius
*Attorney, Agent, or Firm*—Robert A. Kulason; James J. O'Loughlin; Robert B. Burns

[57] ABSTRACT

Where a subsea well is completed for production or water injection service, a subsea christmas tree must sealably connect with both the wellhead and the pipeline(s) or subsea manifold template pipework in order that fluids may flow out of (or into) the well. An intermediate series of pipework loops mounted within a space frame, herein referred to as a Flowline Connection Module (FCM) is removably interposed between the subsea wellhead and the subsea christmas tree to facilitate the piping connections. Each of the modules is further provided with removable U-looped pipework spools at its extremities and said spools may contain adjustable chokes to control the flow of fluids into or out of the wells. The replacement of one choke spool with another may adapt the service function of the well from, for example, production to water injection.

9 Claims, 5 Drawing Sheets

FCM ARRANGED FOR GAS LIFTED PRODUCTION SERVICE ON SATELLITE WELLS

FCM ARRANGED FOR WATER INJECTION SERVICE ON SATELLITE WELLS

FCM ARRANGED FOR GAS LIFED PRODUCTION SERVICE ON TEMPLATE WELLS

FCM ARRANGED FOR CHOKE CONTROLLED PRODUCTION SERVICE ON TEMPLATE WELLS

FCM ARRANGED FOR CHOKE CONTROLLED PRODUCTION SERVICE ON SATELLITE WELLS

FCM ARRANGED FOR WATER INJECTION SERVICE ON TEMPLATE WELLS.

SUBSEA WELL HEAD TEMPLATE

This is a continuation of application Ser. No. 063,888, filed June 19, 1987, abandoned; which is a continuation-in-part of application Ser. No. 834,164, filed Feb. 27, 1986, abandoned.

Subsea wells located on the seabed comprise well casings extending into the earth and a wellhead, being an extension of one of the casing strings, extending above seabed level.

For guideline drilling operations, there must be a guidance arrangement consisting of four vertical guide posts equi-spaced radially about the wellhead to which guidelines from an over-positioned floating drilling rig are attached. This system of guide wires and guide posts is used to guide blowout preventers and, where applicable, subsea completion equipment such as subsea christmas trees from the rig onto the wellhead whence a sealable connection is made with the wellhead.

Where a single well is to be drilled into the seabed, the above-mentioned guidance arrangement is usually supported from a guide base which is run with and connects onto the outermost and shortest casing string. If this single well were to be completed for production or water injection service, a subsea christmas tree may be run and sealably connected to the wellhead. A pipeline (or pipelines) would then be sealably connected to the outlet(s) of the subsea christmas tree to permit the flow of fluids out of (or into) the well to (or from) a surface-based production facility.

Where a plurality of wells is to be drilled from one general location on the seabed, it is often the case that a drilling template structure is used to support the above-mentioned guidance arrangement. In this instance, the template is installed in advance of any drilling activity and wells are drilled through the template well slots one by one. If any of the individual wells were to be completed for production or water injection service, a subsea Christmas tree may be run and sealably connected to the wellhead. In such an instance, it is generally the case that flow of fluids out of or into these wells is contrained and directed by pipework supported by the drilling template structure. It is also generally the case that the majority of this pipework is pre-installed in the template structure in advance of the structure being lowered to the seabed. This pipework will then be sealably connected to the outlets of the subsea Christmas tree(s) and a pipeline (or pipelines) will be sealably connected to the outlet(s) of the manifold pipework to permit the flow of fluids out of (or into) the wells to (or from) a surface-based production facility. Such an arrangement will hereafter be termed a Subsea Manifold Template (SMT). U.S. Pat. Nos. 3,618,661 and 4,438,817 each disclose subsea well drilling apparatus which utilizes a template for accommodating a plurality of wells and which employs a retrievable pipework structure common to all the wells for communicating fluid flows between Christmas trees superimposed on the respective wellheads and fluid flow lines communicating with a remote facility.

Generally it is not known in advance which wellslots will house production wells and which wellslots will house water injection wells. The manifold pipework arrangement is therefore generally designed to accommodate either service to any well slot.

With any subsea producing well, whether it is drilled individually from a guidebase or in combination with others from a drilling template, there remains always the possibility that such a producing well may, at some later point in its life, be required to be converted from its original fluid production service to that of a water injection service. It is therefore of advantage that pipelines or pipework to that well are able to accommodate the well in either production or water injection services.

If the reservoir energy of a subterranean hydrocarbon reservoir is low, it may be necessary to inject water into certain strategic parts of that reservoir to ensure that reservoir pressure is maintained. Where the SMT pipework arrangement is such that one single water injection supply line supplies a common header in the manifold, flow of water into individual wells must be adjusted by the use of chokes. A choke for controlling the flow of injection water into any well may be mounted in pipework in or around its well slot.

Where the SMT pipework arrangement is such that all producing wells supply a common bulk header held at a fixed pressure, it may be necessary to adjust the wellhead pressure of certain producing wells by the use of chokes. A choke for controlling the flow of hydrocarbon fluids from any well may be mounted in pipework in or around its wellslot.

Since it is required to connect the outlet(s) of any subsea christmas tree to the pipeline(s) (in the case of an individual subsea well) or to the SMT pipework (in the case of template-drilled wells) and these connections are required to be made and broken each time the subsea christmas tree is removed to work over the well, it is of advantge if the generally accepted method of utilising vertically oriented connectors for coupling the outlets of said christmas trees to the pipelines or pipework is employed.

When this is the case, the connections can be effected by downward motion of said christmas tree as it lands and engages with the wellhead. To make a number of such pipework connections external to the wellhead connector at the time said christmas tree is landed requires that a degree of structural flexibility be incorporated within the pipework system. One way of achieving this flexibility is to mount long intermediate pipework spools between the subsea christmas tree and the pipelines (in the case of an individual subsea well) or to the SMT pipework (in the case of template-drilled wells) to hold said pipework spools on a framework, which supports the vertically orientated connectors, so that they are provided with a degree of horizontal freedom and to interpose said framework and pipework spools between the subsea christmas tree and the guide base (in the case of an individual well) or the template framework (in the case of template-drilled wells).

By providing pipework loops to cover all possible service functions (eg, bulk oil, production test, water injection and gas lift), the aforementioned system advantage of service flexibility can be achieved. Recoverable modularised pipework spools at the extremities of the interposed framework are designed to interconnect with different sections of the pipework arrangement; the service function of a well can thus be easily changed by replacing one modularised pipework spool with another. The modularised pipework spools are most advantageously designed to be replaced with the subsea Christmas tree in place.

These modularised pipework spools serve as ideal locations to mount the aforementioned water injection, gas lift or production chokes, since they are located within each wellbay and the chokes can be readily serviced or replaced by recovering the spool.

An object of the invention is to provide a degree of pipework interchangeability so that the service function of a well can be easily changed preferably without necessarily having to pull the subsea Christmas tree.

Another object of the invention is to provide a means of mounting chokes to control the flow of fluids into or out of each well and to allow these chokes to be serviced or replaced preferably without having to pull the subsea tree.

A further object of the invention is to provide a convenient means of connection of a subsea manifold template pipework or pipelines to the subsea Christmas tree outlet(s).

A yet further object of the invention is to provide a degree of structural flexibility in the pipework to allow any of the system's subsea Christmas trees to make the required sealable connections.

It is a further object of the invention to achieve each of the above-mentioned objects or combinations thereof with a modular construction which is able to be installed easily in a subsea environment with the use of divers.

The invention provides a flowline connection structure for a subsea well assembly comprising at least one well head including discrete passages therein for conducting fluids to and from the well during either a production or a liquid injection phase of its operation, a base structure supported on the ocean floor to encompass one, or a plurality of, well heads, at least one flow control subsea tree detachably engagable with the base structure for regulating fluid flows passing into and out of the, or a respective, well, and pipelines communicating with remotely located means for holding well fluids and having access connectors adjacent said base structure which are connected to said subsea tree by the flowline connection structure removably mounted on the base structure, characterized in that the flowline connection structure has fluid flow pipework thereon defining flow paths for well fluids to pass therethrough in different modes of operation of the associated well in either the production or injection function thereof, and including separate pipework sections which can be mounted on the flowline connection structure to complete the flow paths required for a selected mode of operation.

Embodiments of the invention will now be described by way of example and with reference to the accompanying drawings, in which.

Figure 1:
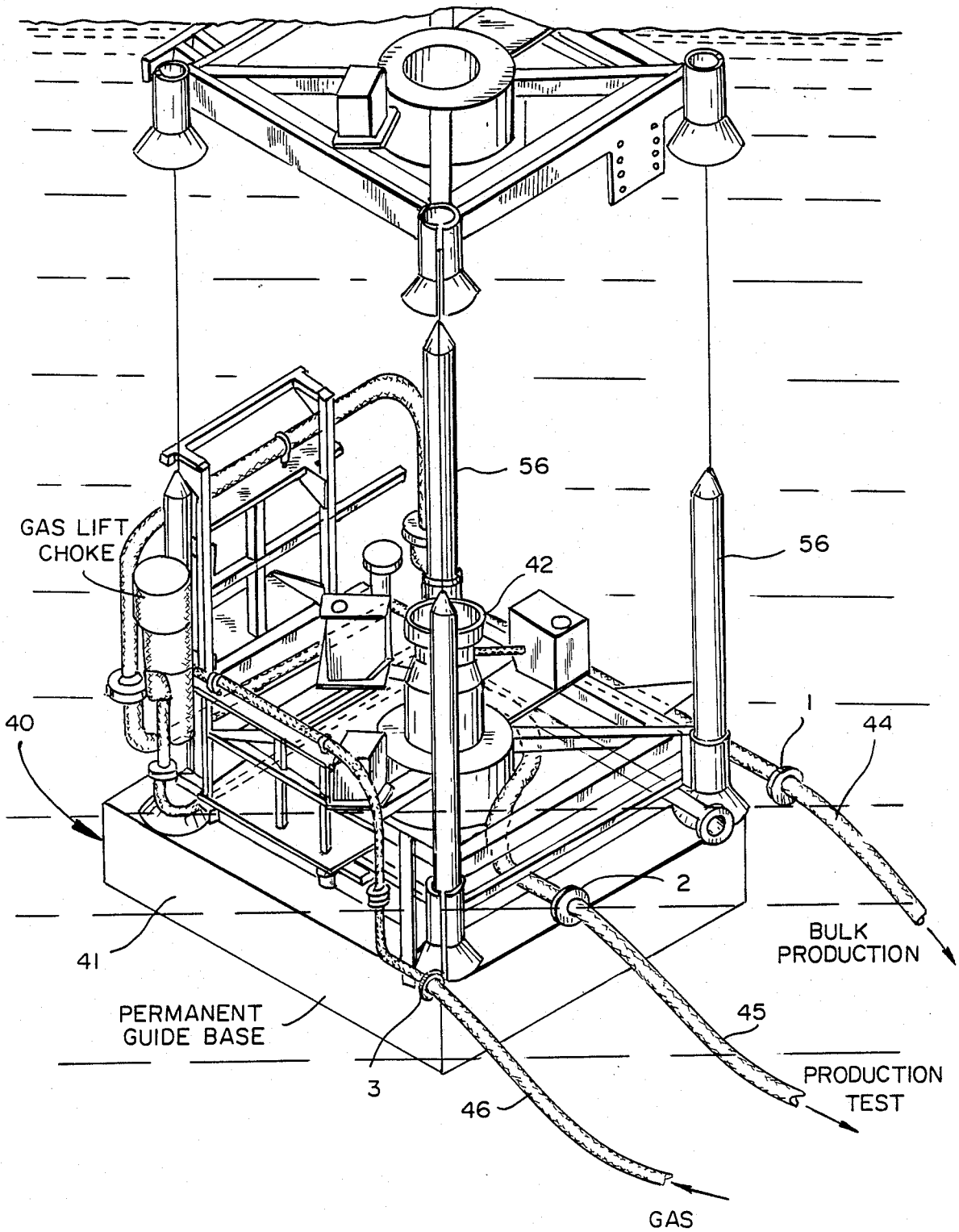
FIG. 1 is a perspective view of a wellhead drilling assembly incorporating a flowline connection module (FCM) according to the invention.
Figure 2:
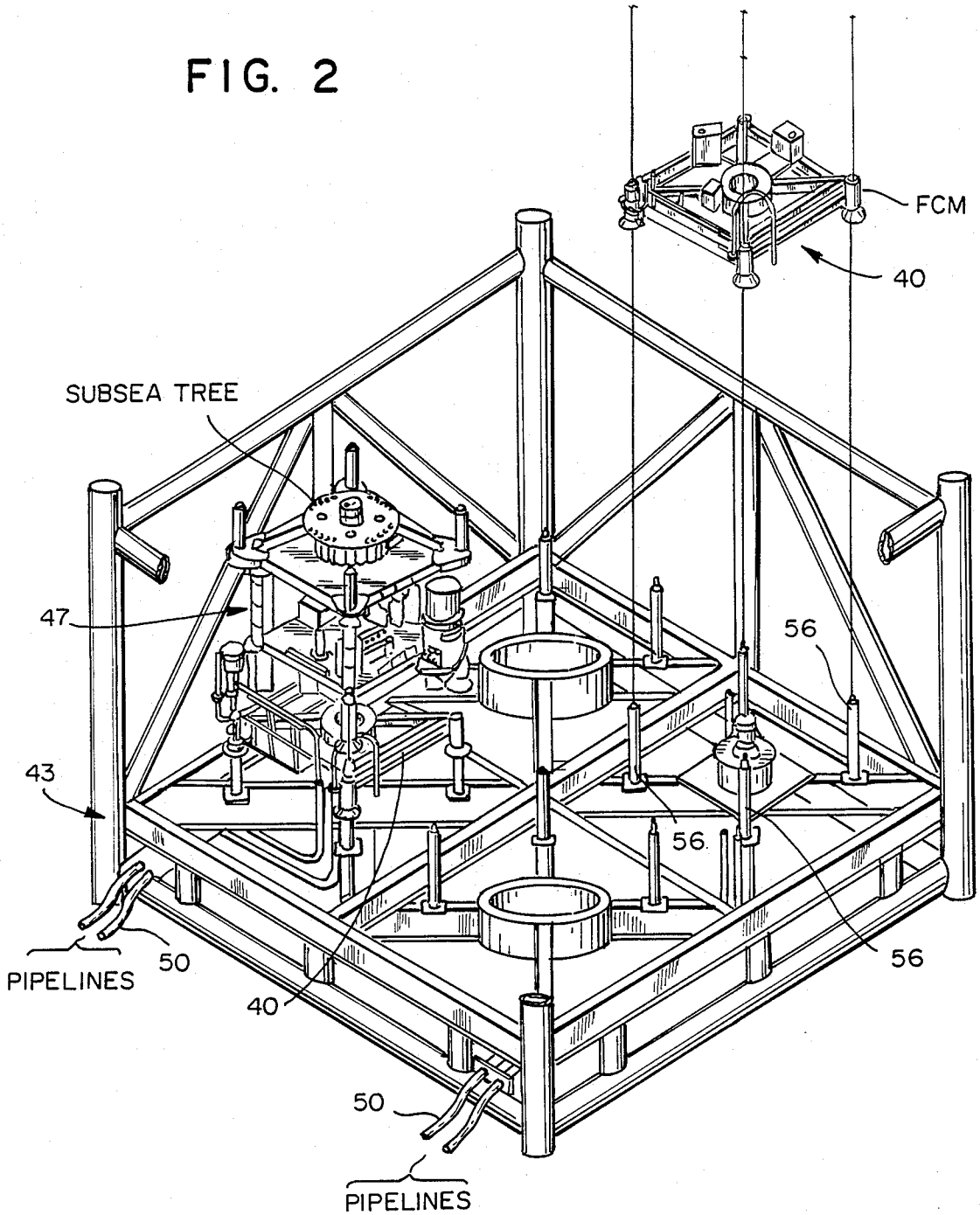
FIG. 2 is a perspective view, partly broken away, of a flowline connection module according to the invention for use in a subsea manifold template.

Towards achieving the foregoing objectives, the hereinafter disclosed invention, the 'Flowline Connection Module' is shown in its operational position in FIGS. 1 and 2. FIG. 1 shows a Flowline Connection Module (40) (hereinafter referred to as an FCM) in position between the permanent guide base (41) and the wellhead (42) of an individual subsea satellite well. Such a variation in the form of the invention shall hereinafter be referred to as a 'Satellite FCM'. FIG. 2 shoes an FCM (40) in position on a subsea manifold template (43). Such a variation in the form of the invention shall hereinafter be referred to as a 'Template FCM'.

FIG. 1 indicates a subsea satellite well which will be used to produce oil and gas back to a pipework manifold arrangement positioned on the seabed some distance away from the satellite well. Oil, gas (and possibly water) from like satellite wells will be co-mingled at the seabed manifold, whence the fluids will flow to a surface-based production facility where the produced oil, water and gas will be separated.

The satellite well shown in FIG. 1 will have relatively low energy and will have a low gas/oil ratio. Therefore, to assist the flow of oil from the well to the seabed manifold, gas will be bubbled into the production tubing of the well at a point deep in the well and the oil will be 'gas lifted' to the surface.

In order occasionally to meter the flow of fluids from such a satellite well, it will be necessary to divert its flow from the pipeline containing the co-mingled flow of all satellite wells (the 'bulk production' pipeline) and to redirect its flow into a separate 'production test' pipeline.

If, therefore, the well normally flows along a 'bulk production' flowline (44) to the seabed manifold; if the flow diversion from 'bulk production' to 'production test' takes place at the satellite wellsite; and if the satellite well requires gas for gas lifting the well, the well must be connected to the seabed manifold by three flowlines, one flowline (44,45,46) for each of the 'bulk production', 'production test' and 'gas lift' services. The three flowlines connect with horizontal sections of the Satellite FCM pipework at the flange connections respectively indicated by (1, 2 and 3) in FIG. 3.

The flow of fluids into and out of the well is controlled by a valve arrangement sealably connected to the wellhead at the seabed. Such an arrangement is known as a subsea Christmas tree (47). It is of advantge if the 'bulk production' and 'production test' outlets and the 'gas lift' inlet to the subsea christmas tree are connected to the FCM pipework by utilising vertically orientated connectors to facilitate removal and reconnection of the subsea christmas tree during a workover of the well. These connectors are shown respectively by (4, 5 and 6) in FIG. 3. To ensure that the connection between subsea christmas tree and FCM pipework can be successfully and repeatably effected (possibly with different replacement subsea christmas trees), the connectors (4, 5 and 6) must be allowed to 'float' both laterally and axially. To achieve this 'float' in the connectors, a degree of structural flexibility must be introduced into the system and this is provided by the relatively long pipework loops between the flange connections (1, 2 and 3) and the connectors (4, 5 and 6).

The FCM pipework is supported by a structural space frame (7) which locates the FCM assembly centrally about the wellhead and engages the four guide posts by means of a plurality of guide funnels (8) to achieve correct radial orientation.

Where the seabed manifold arrangement is such that one single gas supply pipeline supplies a common header in the manifold and where this common header supplies gas to more than one subsea well for the purpose of gas lifting these wells, the flow of gas into an individual well must be controlled by the use of a choke. The FCM pipework arrangement indicated in FIG. 3 includes a choke (9) in the gas lift line for such a purpose. The choke is designed to form part of a U-looped pipework spool (10) with downward facing flange connections (11 and 12) which connect with (and therefore form part of) the FCM gas lift pipework.

The U-looped gas lift choke spool (13) is supported by a structural framework (14) which is used to guide the spool's flanges (11 and 12) into an elevated position above the FCM gas lift pipework flanges (15 and 16) whence a jacking mechanism within the framework (14) allows the spool to be moved vertically and laterally relative to the frame to effect a controlled flange-to-flange make-up.

The gas lift choke spool is mounted at an extremity of the FCM and is designed to be able to run vertically past the subsea christmas tree when the tree is in position on the wellhead should it be required to service or replace the choke.

Figure 3:
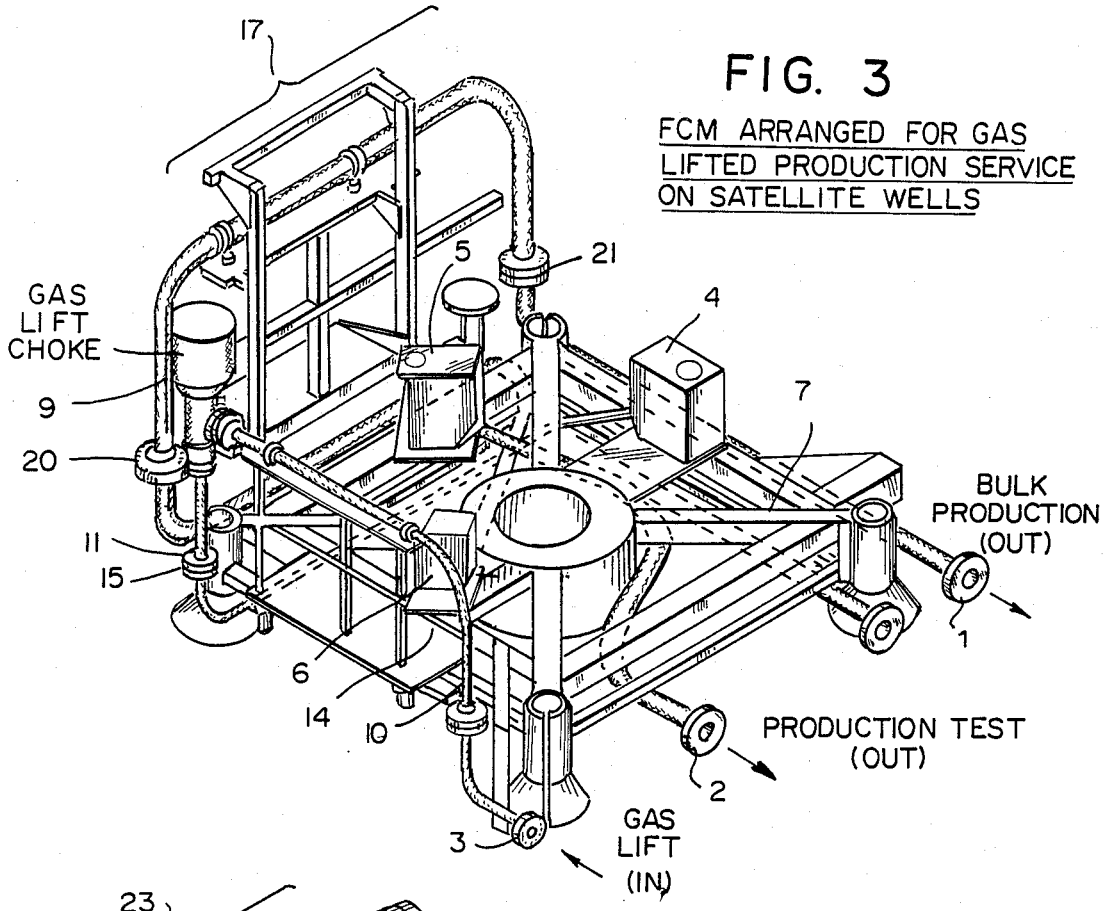
FIG. 3 is a perspective view of an FCM arranged for gas lifted production on satellite wells.

A similar U-looped spool (17) is indicated in FIG. 3 forming part of the FCM 'bulk production' pipework. As with the gas lift choke spool (13), this 'production changeout' spool (17) is supported in a modularised framework and is able to run past the subsea christmas tree when the tree is in position on the wellhead. The purpose of the production changeout spool (17) will be described later.

Figure 4:
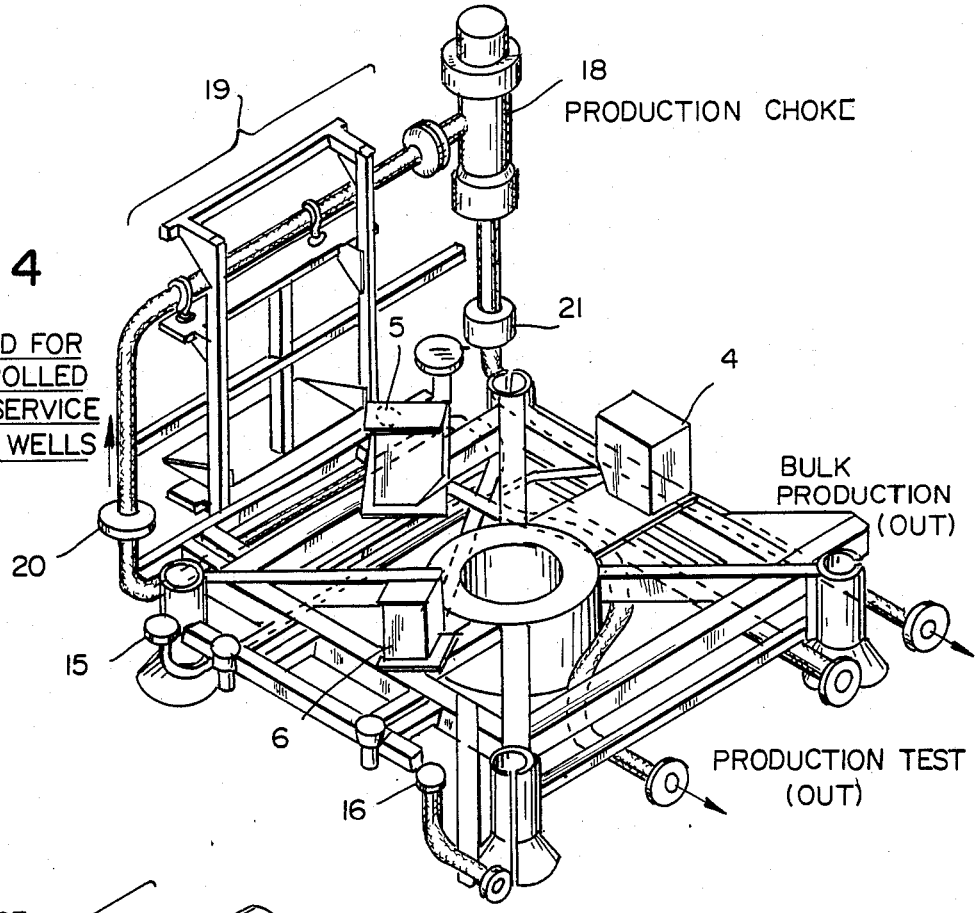
FIG. 4 is a perspective view of an FCM arranged for choke controlled production service on satellite wells.

FIG. 4 indicates a variation of a Satellite FCM which might be installed on a satellite well having relatively high energy and which would provide a normally flowing wellhead pressure in excess of the operating pressure of the 'bulk production' header and 'bulk production' pipeline associated with the seabed manifold. In this case, the wellhead pressure must be reduced to that of the bulk production header by choking the flow at the well. The FCM pipework arrangement indicated in FIG. 4 includes a choke (18) in the bulk production pipework for such a purpose. In a similar manner to the gas lift choke spool (13), the production choke spool (19) is designed to form part of a U-looped pipework spool supported by a structural framework which is used to guide and support the spool to allow it to effect a controlled flange-to-flange make-up with the bulk production pipework.

No gas lift choke spool is required for such a well and, therefore, the gas lift pipework flanges (15 and 16) remain unconnected.

Comparison of FIGS. 3 and 4 indicates that the production choke spool and the production changeout spool are connected to the same flanges (20 and 21) in the FCM's bulk production pipework. Therefore, should the wellhead pressure of the originally relatively high energy well decrease with time such that its wellhead pressure at some point equals that of the bulk production header, there will no longer be a need for the production choke and the production choke spool (19) could be replaced by the production changeout spool (17). The characteristics of the produced fluids may be such that flow from the well could be enhanced by gas-lifting the well and a gas lift choke spool could be connected to flanges 15 and 16 and the FCM variation reverts to that configuration indicated by FIG. 3.

Figure 5:
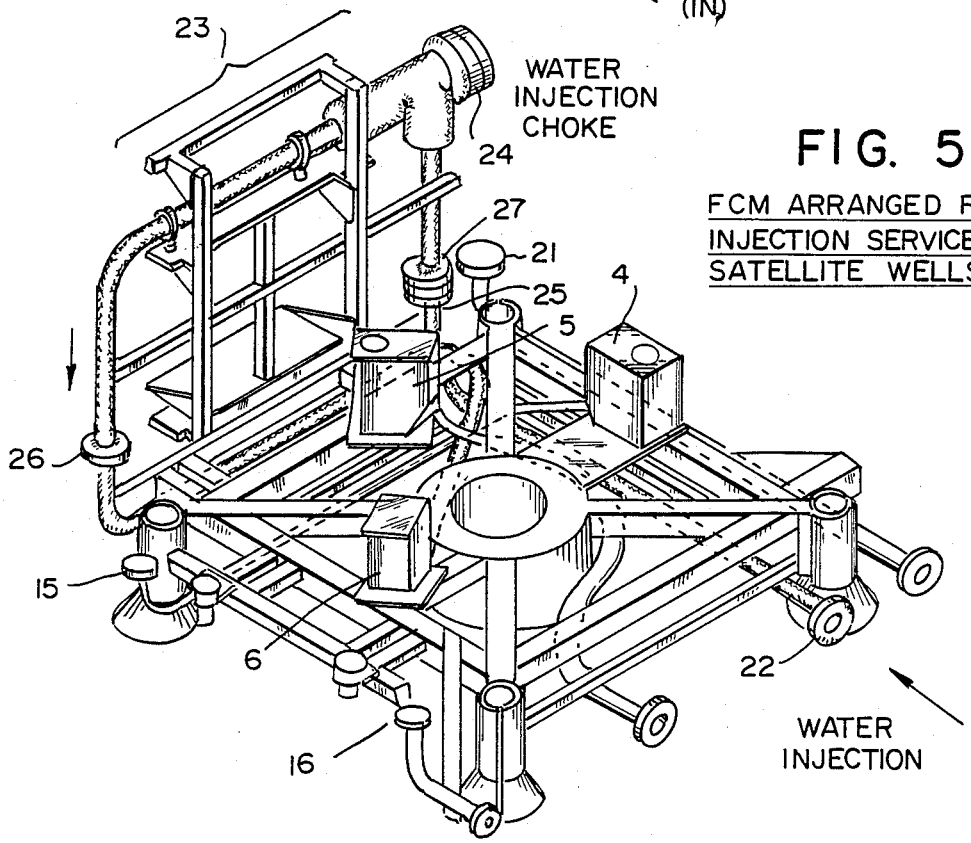
FIG. 5 is a perspective view of an FCM arranged for water injection service on satellite wells.

FIG. 5 indicates a variation of a Satellite FCM which might be installed on a satellite well used for water injection to maintain the reservoir pressure. A pipeline from a nearby platform or SMT will connect with the FCM water injection pipework at flange (22) and water will enter the subsea tree (and hence the well) through tree/FCM connector (6) via the water injection choke spool (23). Flow of water into the well is controlled by varying the setting of the water injection choke (24). The water injection choke spool comprises a U-looped pipework spool supported by a structural framework which is used to guide and support the spool to allow it to effect a controlled flange-to-flange make-up with the FCM water injection pipework in a similar manner to the production choke spool (19). Water injection choke spool flanges (26 and 27) mate respectively with the FCM water injection pipework flanges (20 and 25).

No production or gas lift choke spools are installed on the FCM when in the water injection mode and, therefore, flanges (15), (16) and (21) remain unconnected.

Figure 6:
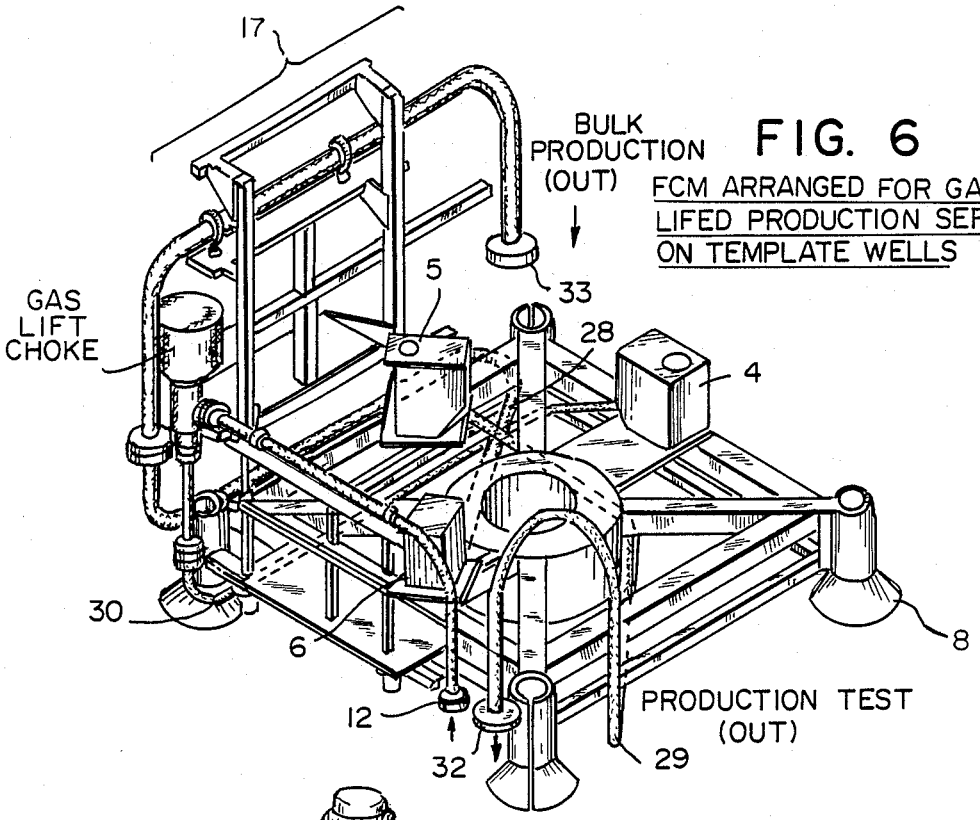
FIG. 6 is a perspective view of an FCM arranged for gas lifted production service on template wells.
Figure 7:
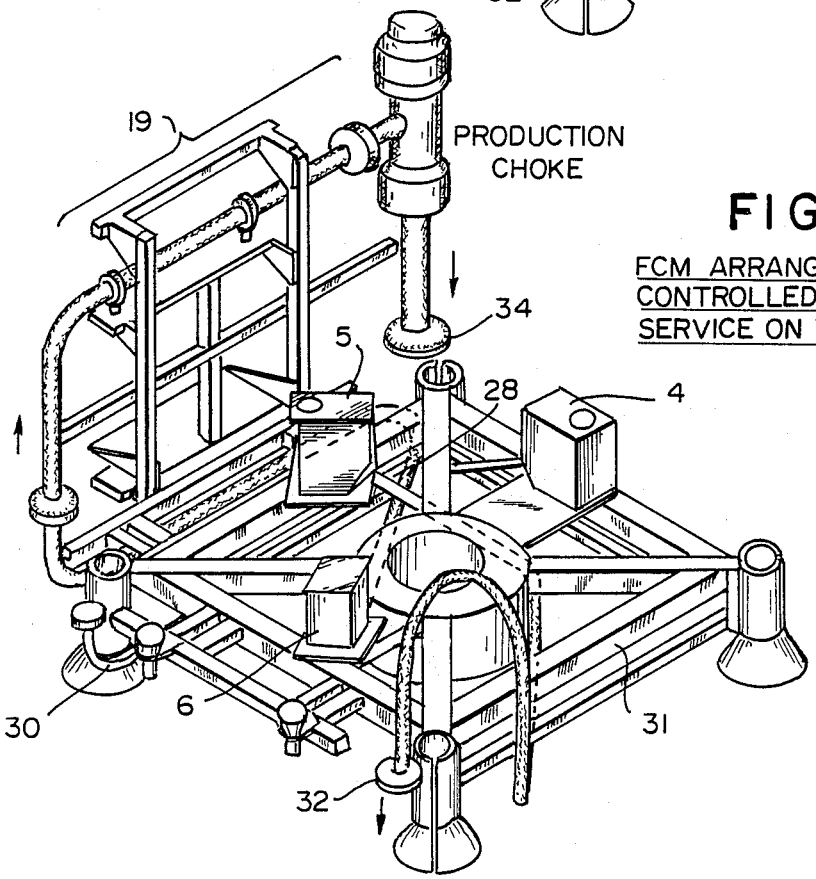
FIG. 7 is a perspective view of an FCM arranged for choke controlled production service on template wells.
Figure 8:
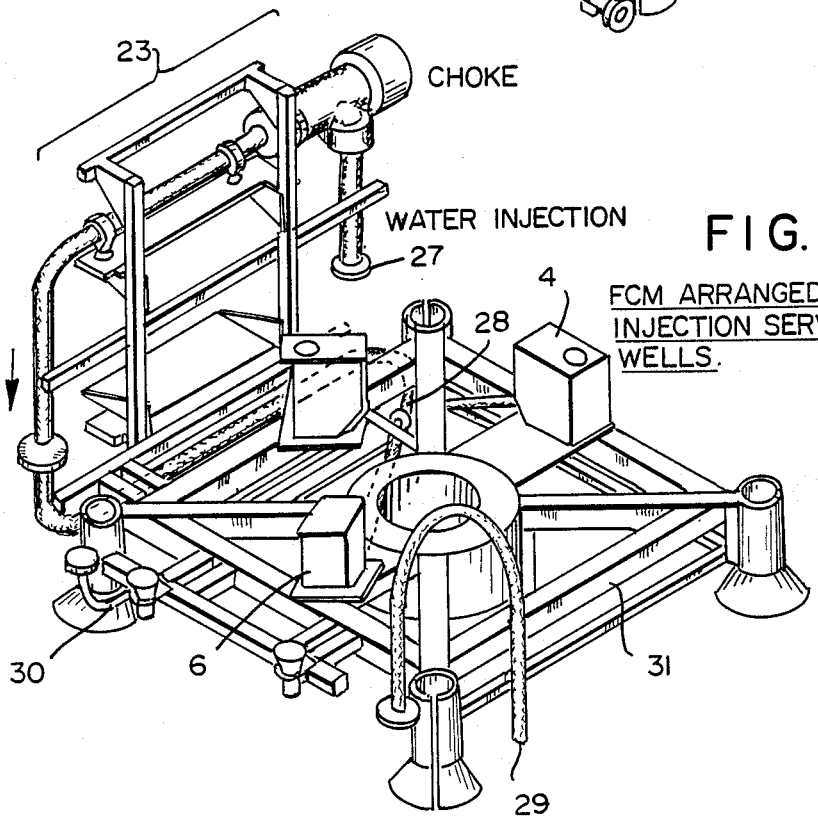
FIG. 8 is a perspective view of an FCM arranged for water injection service on template wells.

By comparing FIGS. 3, 4 and 5, it can be seen that a producing well is able to be converted to water injection service by simply replacing one choke spool with another. The choke spools are positioned outside the plan envelope of the subsea tree and so the choke spools can be removed and replaced without having to kill the well and remove the subsea tree. Similarly, a subsea tree can be removed during a workover without having to remove the choke spools and, since the tree/FCM interface is a simple vertical connection, reinstatement of pipework integrity following a workover is a time-efficient process. It has been shown that a Satellite FCM can be equipped with different choke spools to permit use in different service functions. In a similar manner, a Template FCM can be equipped with the same interchangeable choke spools (13, 17, 19 and 23) to allow the same service flexibility from an SMT. The three Template FCM arrangements for gas-lifted production service, choke-controlled production service and water injection service are shown in FIGS. 6, 7 and 8.

The Template FCM pipework permits identical subsea christmas tree/FCM interfaces to the Satellite FCM (4, 5 and 6) and therefore the same christmas trees can be used interchangeably in both Template and Satellite applications.

As with the Satellite FCM, the Template FCM bulk production, production test, water injection and gas lift pipework runs (28, 29, 28 and 30 respectively) are supported by a structural space frame (31) which locates the FCM assembly centrally about the wellhead and engages the four guide posts (56) by means of a plurality of guide funnels (8) to achieve correct radial orientation. In the case of the Template FCM, however, the terminations of the FCM pipework runs have their central axes vertical (as opposed to the Satellite FCM where they are horizontal) so that a vertical flange-to-flange make-up can be achieved between Template FCM pipework and SMT pipework (50). The Template FCM is lowered such that the pipework flanges (12, 27, 32, 33 and/or 34) are in an elevated position relative to the mating SMT flanges, whence a jacking mechanism within the FCM framework (31) allows the FCM to be lowered vertically relative to the SMT to effect a controlled flange-to-flange make-up.

I claim:

1. A flowline connection structure for subsea wells comprising at least one well head including discrete passages for conducting fluids to and from a well during either a production or a liquid injection phase of operation, a base structure template supported on the ocean floor to encompass a plurality of well heads, at least one flow control subsea tree detachably engageable with the base structure and communicated with a well head for regulating fluid flows passing into and out of one or more of the respective wells, and pipelines communicating with remotely located means for holding well fluids and having access connectors adjacent said base structure which are connected to said subsea tree by the flowline connection structure removably mounted on the base structure, said flowline connection structure including means to removably receive fluid flow pipework thereon defining flow paths for well fluids to pass therethrough during different modes of operation of an associated well in either the production or injection function, and including fluid flow pipework defining flow paths for well fluids to pass through the different modes of operation of an associated well in either the production or injection function thereof, and including separate pipework sections which are adapted to be selectively and detachably engaged with discrete segments of said fluid flow pipework, and communicably mounted on the flowline connection structure of a single well, without interrupting operation of other wells associated with said base structures, whereby to complete the flow paths to achieve a selected mode of operation of said single well.

2. A flowline connection structure according to claim 1 wherein the separate sections of said pipework are locatable on the flowline connector structure at positions to allow them to be installed or removed without necessitating the removal of said subsea tree mounted thereon.

3. A flowline connection structure according to claim 1, wherein each pipework section comprises a generally inverted U-shape pipework spool having downwardly-facing flanged terminal portions for connection to a pair of upwardly-facing flanged terminal portions of other sections of said pipework, an upwardly-facing flanged terminal portion of pipework provided on a subsea well template.

4. A flowline connection structure according to claim 1, wherein a flow control choke is provided in at least one of the separate pipework sections.

5. A flowline connection structure according to claim 1, including a structural framework for supporting a pipework spool to guide it into an elevated position above the pipework with which it is to be connected.

6. A flowline connection structure according to claim 5, including a jacking mechanism within said framework, adapted to allow the spool to be moved vertically and laterally relative to the framework to enable a controlled flange-to-flange connection to be effected.

7. A flowline connection structure according to claim 6, wherein said module comprises a docking port, and a plurality of guide sleeves spaced outwardly of the docking port, each guide sleeve defining a substantially vertically aligned passage for engaging a substantially vertical guide piece on the aforesaid base structure for registering said docking port with the respective well head.

8. A flowline connection structure according to claim 1, wherein said flow paths communicate with upwardly facing fluid receptacles for sealably registering with respective downwardly projecting nozzles provided on the respective subsea tree.

9. A flowline connection structure according to claim 8, wherein said pipework is provided by elongate pipework loops which have a degree of structural flexibility allowing lateral and axial movement of the upwardly-facing fluid receptacles to assist mating of said nozzles therewith.

* * * * *